United States Patent [19]

Walker

[11] 4,308,610

[45] Dec. 29, 1981

[54] GEAR TRAIN FOR ANALOG DISPLAY TIMEPIECE

[75] Inventor: Erich Walker, Orvin, Switzerland

[73] Assignee: Bulova Watch Company, Inc., Flushing, N.Y.

[21] Appl. No.: 99,861

[22] Filed: Dec. 3, 1979

[30] Foreign Application Priority Data

Dec. 8, 1978 [CH] Switzerland ..... 12553/78

[51] Int. Cl.[3] ..... G04B 19/02; G04B 29/00

[52] U.S. Cl. ..... 368/220; 368/323

[58] Field of Search ..... 368/76, 80, 220, 228, 368/323

[56] References Cited

U.S. PATENT DOCUMENTS 2,781,630 2/1957 Bamat ..... 368/220

3,290,875 12/1966 Egger et al. ..... 368/220

4,000,384 12/1976 Kumazawa ..... 368/220

4,074,517 2/1978 Tatsumi et al. ..... 368/220

*Primary Examiner*—Vit W. Miska

*Attorney, Agent, or Firm*—Michael Ebert

[57] ABSTRACT

An electronic or mechanical timepiece of the analog display type provided with a gear train for driving timekeeping hands. The gear train includes a center pipe affixed to an intermediate bridge secured to the base plate, a free cannon pinion being rotatably supported on the pipe and having a center wheel mounted thereon which is disposed in the space between the bridge and a section of the base plate, thereby providing a dependable support for the cannon pinion without the need for enlarging the diameter of the center wheel or of the drive pinion intermeshing therewith.

6 Claims, 3 Drawing Figures

GEAR TRAIN FOR ANALOG DISPLAY TIMEPIECE

BACKGROUND OF INVENTION

This invention relates generally to timepieces having an analog display, and more particularly to an improved gear train for driving the timekeeping hands of a watch of this type.

In a mechanical watch of the analog type, the hour, minute and seconds hands are driven by a spring-wound motor through a gear train functioning to turn the hour, minute and seconds wheels to which the hands are attached. In an electronic watch of the analog type, the gear train, which turns these wheels, is usually driven by a stepping motor actuated by timed electrical pulses. The present invention is applicable to both electronic and mechanical analog watches.

The invention deals with an analog timepiece whose gear train includes a fixed center pipe on which a free cannon pinion and a tubular extension of an hour wheel concentric therewith are rotatably supported. The disadvantages incident to a prior art arrangement of this type are spelled out in an analysis of the prior art which precedes the detailed description of the invention in a subsequent section of this specification.

The following Swiss patents represent relevant prior art: Swiss Pat. Nos. 342,903; 224,464 and 334,705.

SUMMARY OF INVENTION

The main object of this invention is to provide in an analog display timepiece a gear train having a center pipe which is not directly anchored on a base plate, but on an intermediate bridge secured to the base plate.

Briefly stated, these objects are attained in an electronic or mechanical timepiece of the analog display type provided with a gear train to drive the timekeeping hands. The gear train includes a center pipe anchored on an intermediate bridge secured to the base plate, a free cannon pinion being rotatably supported on the pipe and having a center wheel mounted thereon which is disposed in the space between the bridge and a section of the base plate, thereby providing a dependable support for the cannon pinion without the need for enlarging the diameter of the center wheel or of the drive pinion intermeshing therewith.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Prior Art

Figure 1:
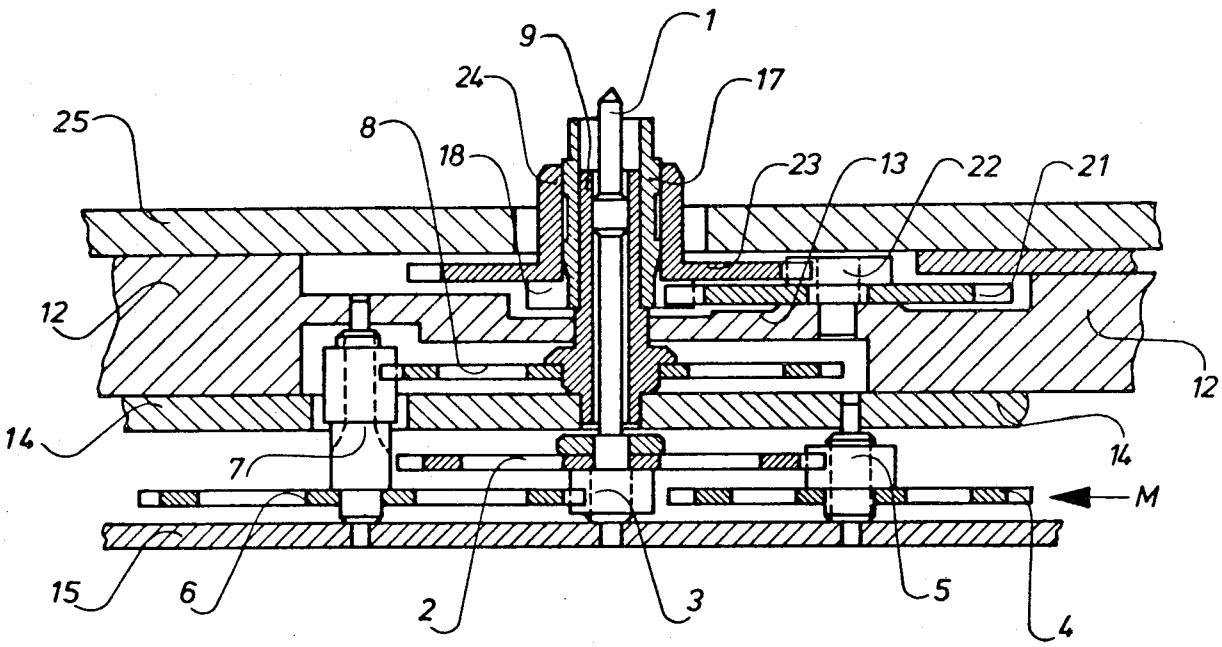
FIG. 1 is a sectional view taken along the geometrical axis of rotation of the hands of the watch through the gear train of a prior art form of analog electronic watch in which no center pipe is provided.

Referring first to FIG. 1, which shows one known form of gear train for use in an electronic or mechanical watch, it will be seen that a central seconds hand shaft designated 1 is connected adjacent one end thereof to a sweep seconds wheel 2. Wheel 2 is driven by a stepping motor or other watch motor (not shown) via an intermediate wheel 4 and the intermediate pinion 5 thereon. Arrow M designates the point where the pinion seated on the rotor of the stepping motor meshes with intermediate wheel 4, whereby as the motor undergoes a stepping action, wheel 4 is caused to turn. Pinion 3 of the seconds wheel 2 meshes with a wheel 6 whose pinion 7 drives a center wheel 8.

In the prior art arrangement illustrated in FIG. 1, center wheel 8 is pressed onto a hollow center wheel spindle 9. This center wheel spindle is supported at one end on a thin wall section 13 of a base plate 12, and at the other end on an intermediate bridge 14 secured to the base plate. The other wheel spindles are received at one end thereof by a wheel-bridge 15. On center wheel spindle 9 there is seated, with frictional engagement, a cannon pinion 17 whose toothing 18, via a minute wheel 21 and its pinion 22, drives an hour wheel 23 that is freely rotatable on the cannon pinion and is provided with a tubular extension 24 to which is attachable an hour hand. A dial 25 covers the train of gears.

The means for setting the hands are not shown in the drawing. As is conventional, when a setting crown is pulled out, these setting means then engage in a customary manner, the toothing 18 and thereby permit turning of the minutes and hour hands to adjust the position of the hour and minutes hands.

The very small distance between the two points of support for center wheel spindle 9 represents the major disadvantage of the above-described construction. If the two boreholes in base plate 13 and intermediate bridge 14 which serve as the bearing support for center wheel spindle 9 are not precisely aligned with each other, or if center wheel spindle 9 has some radial play, this can result in a considerable error in the position of the hands with respect to the dial. The timepiece hands then lie in a plane that is inclined with respect to the dial.

In the case of calendar watches, other defects are encountered; for the day disk will then not turn around a precisely defined axis. Also, there is the danger of undesired movement of the hands during a rapid setting of the day or date. These defects can be effectively counteracted only by maintaining exceptionally tight manufacturing tolerances, which makes mass production difficult and expensive.

Finally, there is the disturbing factor in the above-described construction wherein cannon pinion 17 is seated on and frictionally engages center wheel spindle 9. With this type of coupling, one is also forced to satisfy very small dimensional tolerances in order that, in actual operation, the friction is not greater or less than permissible limits.

Figure 2:
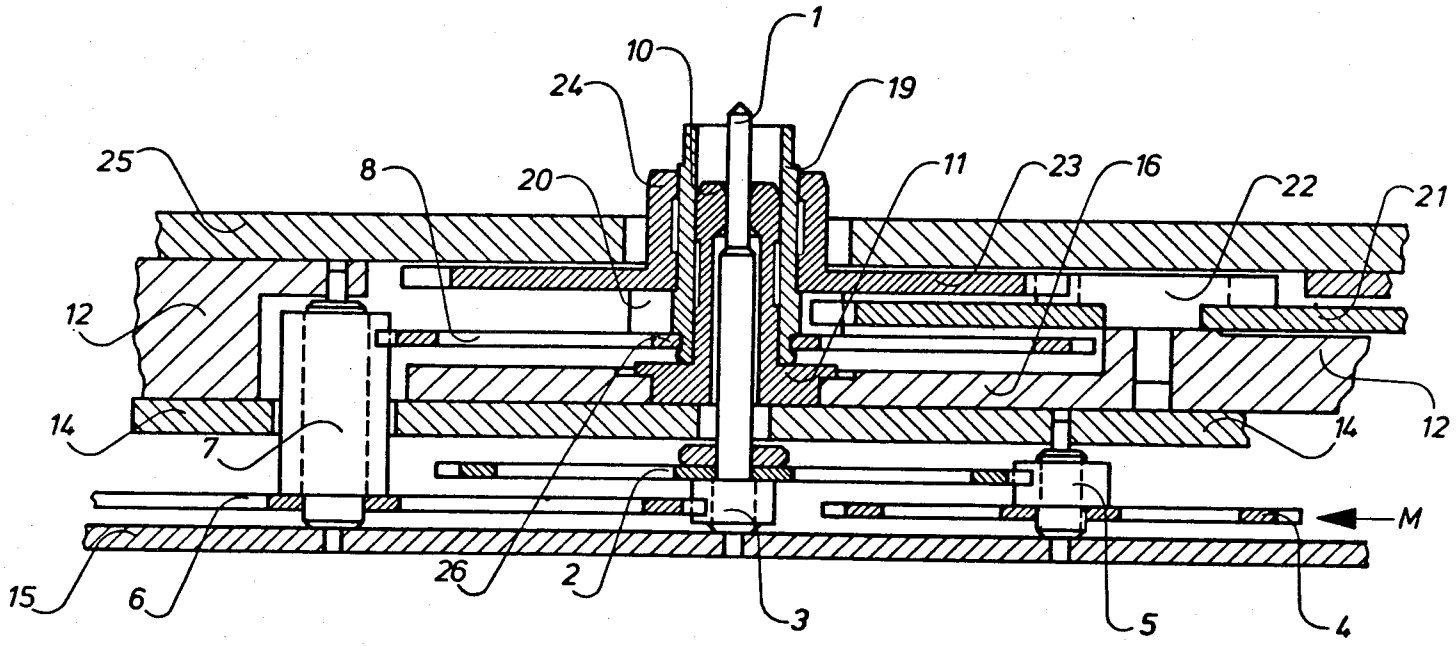
FIG. 2 is a corresponding section taken through the gear train of another known form of gear train in which a cannon pinion is seated on a fixed center pipe.

In an attempt to overcome these drawbacks, it has heretofore been proposed to provide a watch whose gear train is in accordance with FIG. 2. The distinction between FIGS. 1 and 2 resides in the manner of supporting the central spindle or pipe. A hollow center wheel spindle is no longer provided for the centering of these elements. Rather, a bushing piece 11 of a center pipe 10 is anchored in a bore-hole provided on section 16 of the base plate. On this fixed pipe 10, a cannon pinion 19 is free to rotate when its toothing 20 is driven. In order to prevent damage to the drive unit or to the train of gears upon setting of the hands, center wheel 8, by the use of two elastic spokes 26 which are parallel to each other, is held with a clamping fit on cannon pinion 19.

Experience indicates that the structural arrangement shown in FIG. 2 also gives rise to difficulties. The guiding of elements 1, 19 and 24 which carry the timekeeping hands is, to be sure, acceptable. On the other hand, pinion 7 of wheel 6 which drives center wheel 8 must have a relatively large diameter so that the horizontal size of the base plate necessary to assure sufficient mechanical stability in the region of the support of the pinion, does not render impossible the introduction and mounting of center wheel 8.

To assure the required step-down ratio between drive pinion 7 and center wheel 8, this inevitably dictates in the FIG. 2 arrangement, a center wheel having a large diameter. A large diameter center wheel is disadvantageous, especially for watches of small size. However, even for watch mechanisms of larger size, a large center wheel is still a drawback; for it may interfere, from the standpoint of space, with a power cell or battery whose body may occupy a considerable part of the thickness of the watch.

The Invention

Figure 3:
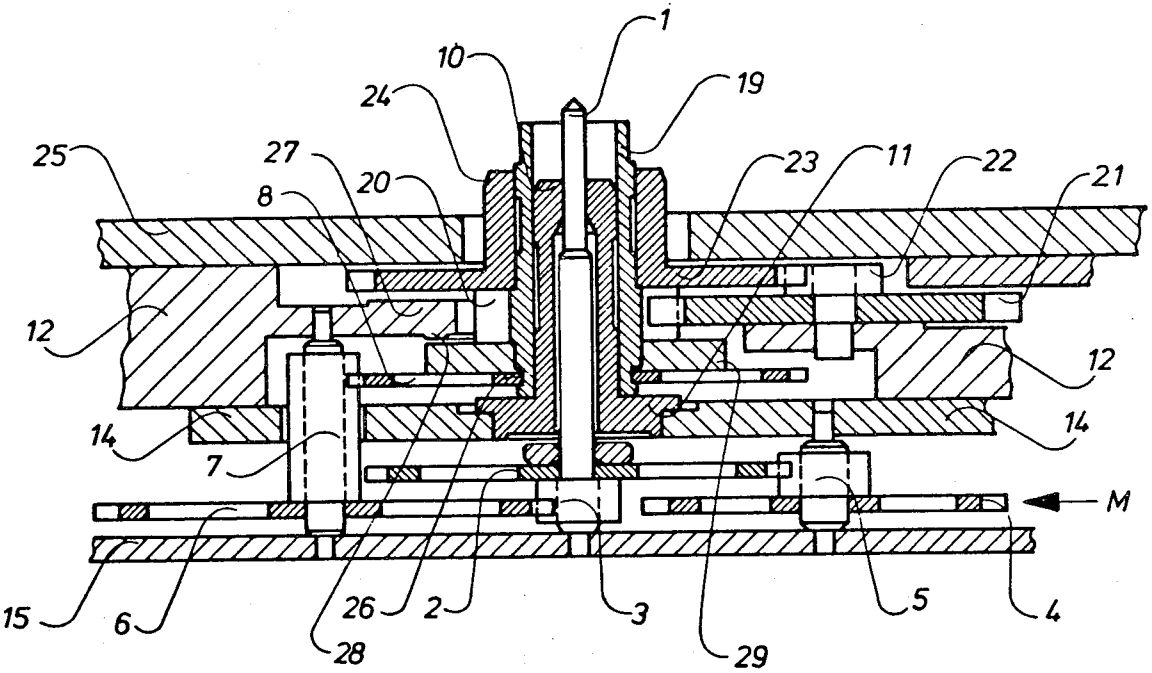
FIG. 3 is a similar sectional view of a gear train in accordance with the invention which includes a center pipe mounted in a novel manner to overcome the disadvantages of prior art constructions.

In order to overcome the disadvantages of the above-described prior art structures, the present arrangement, as illustrated in FIG. 3, includes a structure having a center pipe in which the spatial conditions are more favorable, thereby obviating these disadvantages. To this end, in accordance with the invention, the center pipe 10 is fastened to an intermediate bridge.

As will be seen in FIG. 3, bushing piece 11 of center pipe 10 is not arranged on a base plate or a part thereof as in the prior art structure shown in FIG. 2. On the contrary, bushing piece 11 is pressed into a corresponding borehole in intermediate bridge 14 secured to base plate 12. It now becomes possible to clamp center wheel 8 so that it frictionally engages the free cannon pinion 19 and is located in the gear space between intermediate bridge 14 and a section 27 of base plate 12.

Aside from the generally better utilization of the space gained by this arrangement, center wheel 8 can now be introduced from the bottom side of the movement (during the mounting of the intermediate bridge), with the result that the parts of the base plate which protrude into the region in drive pinion 7 is supported are no longer disturbing. In this way, pinion 7 is properly supported.

Furthermore, the section of the base plate, designated 27 in FIG. 3, can function as a mating stop for stop means extending over the entire periphery of center wheel 8; i.e., the entire angular range of 360°. In the example shown in FIG. 3, the stop means consist of a circular disk 29 pressed onto cannon pinion 19. Disk 29 lies with one of its flat sides against an arcuately-extending shoulder 28 on the base plate section 27, thereby limiting the axial play of cannon pinion 19. This shoulder extends merely over a part of the circumference of disk 29.

While there has been shown and described a preferred embodiment of a gear train for analog display timepiece in accordance with the invention, it will be appreciated that many changes and modifications may be made therein without, however, departing from the essential spirit thereof.

I claim:

1. In an analog display timepiece whose timekeeping hands are driven by a gear train, the train comprising:

A. a base plate having an intermediate bridge secured thereto spaced from a section of the plate to define a gear space;

B. a center pipe normal to the base plate and affixed at one end to said bridge, said center pipe having a seconds hand shaft coaxially disposed therein;

C. a free cannon pinion mounted on said center pipe;

D. an hour wheel having a tubular extension concentric with said cannon pinion and rotatable thereon; and E. a center wheel disposed in said gear space and frictionally clamped on said cannon pinion, said cannon pinion being provided with toothing engaged by a minute wheel, the center wheel being provided with stop means extending radially beyond said toothing and cooperating with a counter stop formed on said section of the base plate.

2. A gear train as set forth in claim 1, wherein said stop means is defined by a disc which is pressed on said cannon pinion, one face of said disc cooperating with said counter stop.

3. A gear train as set forth in claim 2, wherein said counter stop is defined by an arcuate shoulder formed on said section of the base plate.

4. A gear train as set forth in claim 3, further including a wheel having a drive pinion intermeshing with said center wheel and supported for rotation between the section of the base plate and a wheel bridge parallel to said intermediate bridge, said drive pinion passing through a bore in said intermediate bridge.

5. A gear train as set forth in claim 4, further including a seconds wheel mounted on said seconds hand shaft below said intermediate bridge, said seconds wheel having a pinion intermeshing with said drive pinion wheel.

6. A gear train as set forth in claim 5, wherein said free cannon pinion is provided with toothing which intermeshes with a minute wheel whose pinion intermeshes with an hour wheel rotatable on said free cannon pinion.

* * * * *